US005829986A

United States Patent [19]

Kong

[11] Patent Number: 5,829,986

[45] Date of Patent: Nov. 3, 1998

[54] SINGLE LAYER, MULTI-CHANNEL BAND-GEAR SYSTEM FOR ROTARY JOINT

[75] Inventor: Kin Yuen Kong, Baldwin, N.Y.

[73] Assignee: Honeybee Robotics, Inc., New York, N.Y.

[21] Appl. No.: 797,140

[22] Filed: Feb. 10, 1997

[51] Int. Cl.[6] ..... H01R 39/00

[52] U.S. Cl. ..... 439/13; 439/19

[58] Field of Search ..... 439/13, 15, 17–24, 439/28

[56] References Cited

U.S. PATENT DOCUMENTS

| | | | |
|---|---|---|---|
| 3,489,982 | 1/1970 | Dauphinee | 439/19 |
| 5,501,604 | 3/1996 | Roopnarine et al. | 439/19 |

FOREIGN PATENT DOCUMENTS

| | | | |
|---|---|---|---|
| 2097204 | 10/1982 | United Kingdom | 439/19 |

*Primary Examiner*—Khiem Nguyen

*Attorney, Agent, or Firm*—Leighton K. Chong

[57] ABSTRACT

A multi-channel band-gear system for a rotary joint has a ring gear assembly with a conducting ring band in electrical contact with corresponding conducting bands of a set of intermediary planetary gears, which in turn are in electrical contact with a conducting sun band of a sun gear assembly. The ring band is formed with a plurality of conducting segments which are electrically insulated from each other and positioned angularly in a circumferential direction of the ring gear, such that separate electrical power/signal channels are formed across the rotary joint. In a preferred embodiment having continuously connected channels, the ring band has four conducting segments at 90° intervals, the sun band has two conducting segments at 180° intervals, and three planetary bands are in rolling electrical contact at 120° intervals between the ring band segments and the sun band segments, forming two continuously connected channels in a single layer of the band-gear system. Multiple sets of ring gear, planetary gear, and sun gear assemblies may be used in a stacked configuration in a single axial layer to further increase the number of channels provided through the band-gear system.

5 Claims, 3 Drawing Sheets

SINGLE LAYER, MULTI-CHANNEL BAND-GEAR SYSTEM FOR ROTARY JOINT

This invention was made with government support under Contract #NAS5-38071 awarded by NASA. The government has certain rights in the invention under 37 C.F.R. 401.14(E) (4).

FIELD OF THE INVENTION

The field of the invention is mechatronics. The invention is applicable to the transmission of electrical power and/or signals across a rotary joint through the use of a band-gear system.

BACKGROUND ART

In the prior art, slip rings, roll rings, mercury contact assemblies, and other devices have been used to transmit electrical power or signals across a rotating mechanical interface. Related technology includes electrical contact brushes in many types of motors and torque sensors.

Slip rings, which use ring and brush contacts to transmit electricity across a rotating interface, have problems in that they wear quickly (due to sliding friction of brushes), carry only one channel per layer of brushes, can be electrically noisy, induce too much torque resistance, and generate particle debris through wear. Debris is not a desirable quality for many clean room and aerospace applications. Slip rings are also difficult to align and relatively costly, and have no use in the transfer of mechanical power.

Roll rings have limitations in that only one ring can be used per layer of assembly, thereby limiting the electrical power and signal transmission density. Roll rings also present alignment difficulties in assembly and do not possess suitable mechanical power transmission potential. Mercury contact assemblies are not compact, possess no mechanical power transfer potential, can be costly, and are associated with hazardous material (outgassing of mercury vapor).

A recent development is a band-gear system which employs electrical bands in combination with gears for transmitting electrical power or signals across a rotary joint, for example, as disclosed in U.S. Pat. No 5,501,604 issued on Mar. 26, 1996 in the names of Roopnarine, T. Myrick, and K. Y. Kong (same as the present inventor), which is assigned to Honeybee Robotics Inc., of New York, N.Y. The band-gear system has an outer ring gear assembly with a conducting band in electrical contact with corresponding conducting bands of intermediary planet gears, which in turn are in electrical contact with a conducting band of an inner sun gear assembly mounted to a rotary shaft. Electrical power and/or signals can thus be conducted across a rotary joint which also transmits mechanical power. The principle of the band-gear system can also be used in linear applications to transmit electrical power/signals across a gear in rolling contact with a linear band. For a detailed explanation of the band-gear system, reference is made to the disclosure of U.S. Pat. No. 5,501,604, which is incorporated herein by reference.

U.S. Pat. No. 5,501,604 also shows how a multi-channel band gear system can be constructed by employing a plurality of electrically insulated bands arranged in parallel along the axial direction of the rotary shaft. In such a multi-channel system, increasing the number of channels increases the axial length of the system. In some applications axial space is limited and a reduction in the system axial length is necessary. It is the principal object of the present invention to provide for multi-channel transmission of power/signals in a band-gear system without correspondingly increasing the axial length of the system.

SUMMARY OF THE INVENTION

In accordance with the present invention, a multi-channel band-gear system has a ring gear assembly with a conducting ring band in electrical contact with corresponding conducting bands of a set of intermediary planetary gears, which in turn are in electrical contact with a conducting sun band of a sun gear assembly, wherein the ring band is formed with a first plurality of conducting segments which are electrically insulated from each other and positioned angularly in a circumferential direction of the ring gear. The number and angular positions of the ring band segments are selected with respect to the number of planetary gears and the sun band such that separate electrical power/signal channels are formed.

In a preferred embodiment having continuously connected channels, the ring band has four conducting segments arranged at 90° intervals, the sun band is formed with two electrically insulated conducting segments arranged at 180° intervals in alignment with the ring band segments, and there are three planetary bands in rolling electrical contact at 120° intervals between the ring band segments and the sun band segments. With each two opposed ring band segments being paired together, at least one planetary band is in rolling electrical contact between each pair of ring band segments and a corresponding one of the sun band segments at all times, so that two continuously connected channels are provided in the single layer band-gear system. Continuously connected channels are desired in applications where it is desired to maintain a continuous connection in each channel across the rotary joint with a minimum of electrical noise or interference.

The invention also encompasses a multi-stacked band gear system in which multiple sets of ring gear, planetary gear, and sun gear assemblies are stacked in a single axial layer to further increase the number of channels provided in the band-gear system.

Some applications may permit the use of channels that are used only during time-multiplexed or phase divided intervals. In a multiplexed-channel band-gear system, the numbers and the arrangement of ring band segments, sun band segment(s), and planetary bands can be chosen in accordance with the given time-multiplexing or phase division scheme.

Other objects, features and advantages of the present invention are described in detail below in conjunction with the drawings, as follows:

DETAILED DESCRIPTION OF THE INVENTION

Figure 1A:
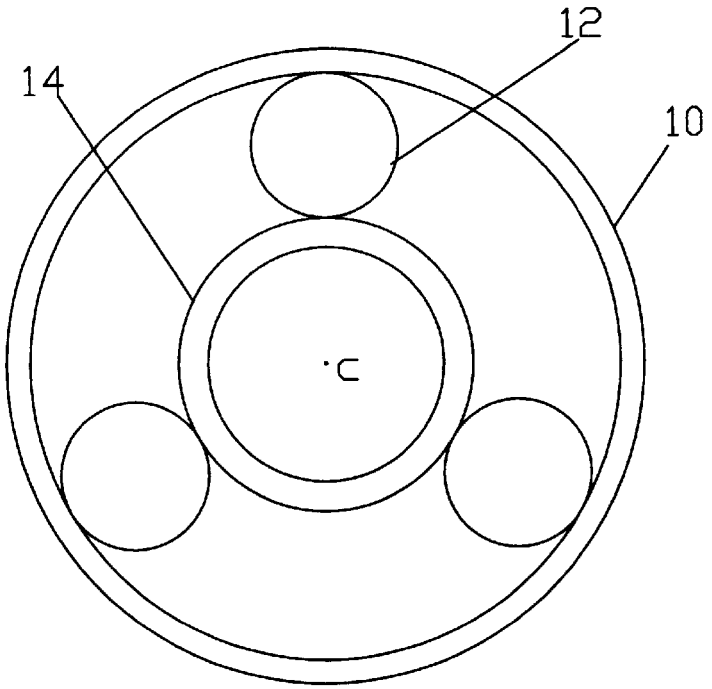
FIG. 1*a* shows a typical configuration for the conducting bands of a band-gear system.

Referring to FIG. 1*a*, a typical configuration for the conducting bands of a band-gear system is shown. A conducting ring band 10 mounted concentrically with its associated ring gear assembly is in electrical contact and geared engagement with corresponding conducting planetary bands 12 of plurality of planetary gear assemblies, which are in turn in electrical contact and geared engagement with a conducting sun band of a sun gear assembly. The ring gear is an external moving part, while the sun gear is mounted to a rotary shaft aligned with a center axis C as an internal moving part. The conducting bands are arranged in a single axial layer. Electrical power and/or an electrical signal can thus be conducted across a rotary joint which also transfers mechanical power. A detailed explanation of the arrangement and operation of the band-gear system is provided in U.S. Pat. No. 5,501,604, which is incorporated herein by reference.

Figure 1B:
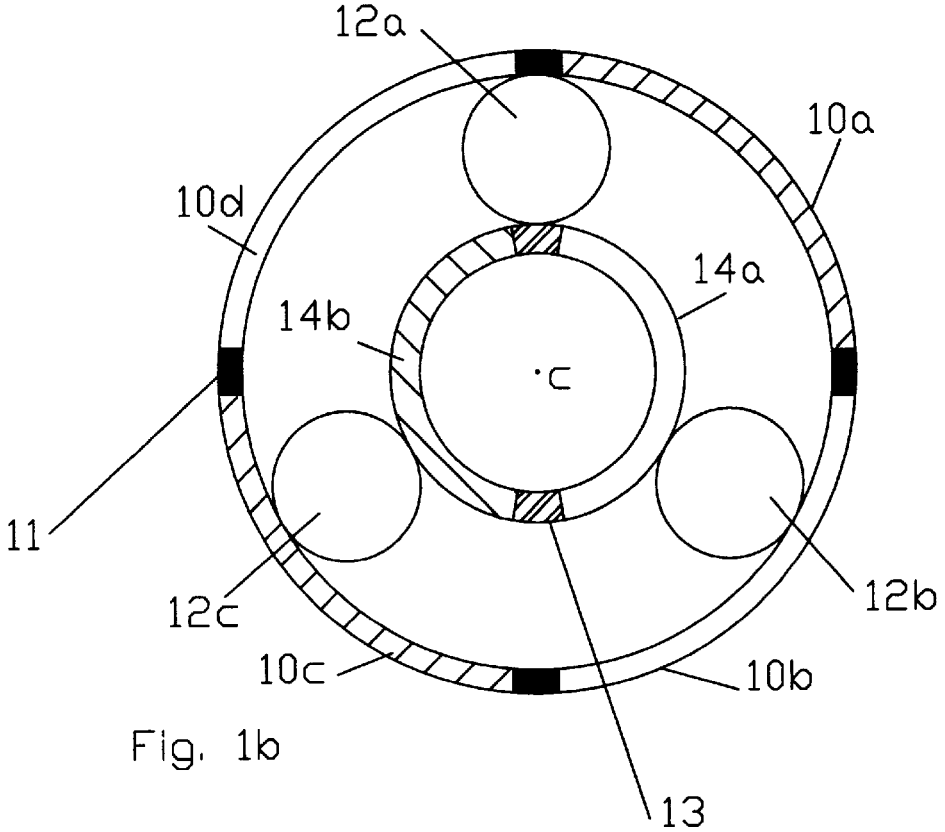
FIG. 1*b* illustrates a preferred embodiment in which two continuously connected channels are provided in a single conducting band layer.
Figure 2A:
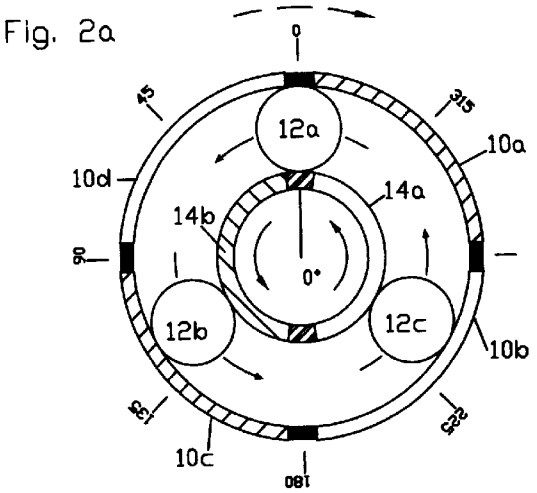
FIGS. 2*a*–2*f* shows the positions of the ring band segments, planetary bands, and sun band segments at different phases of one complete revolution.
Figure 2B:
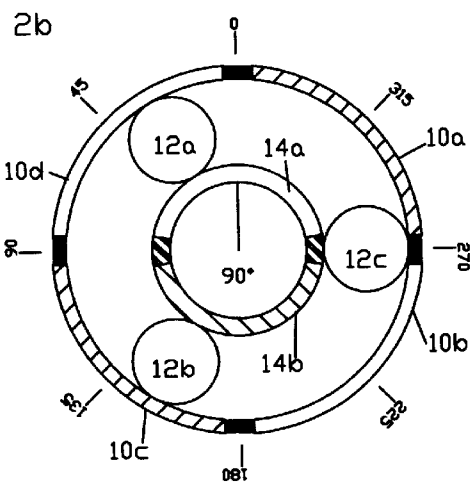
Figure 2C:
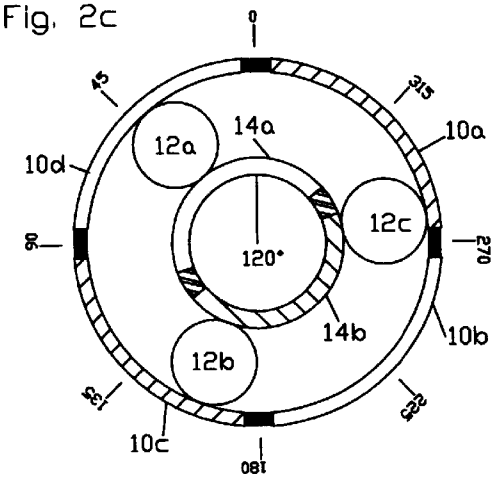
Figure 2D:
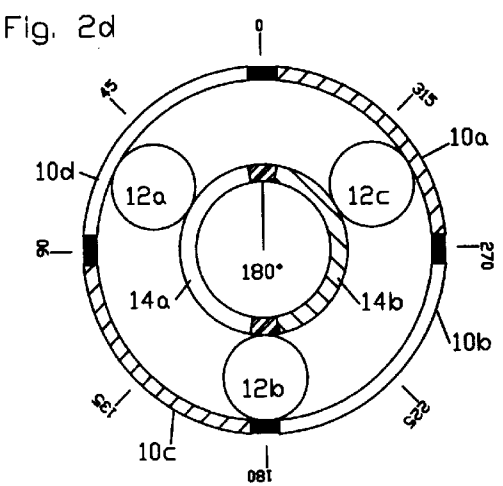
Figure 2E:
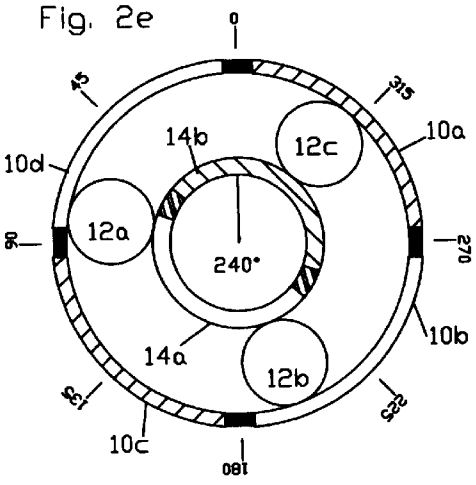
Figure 2F:
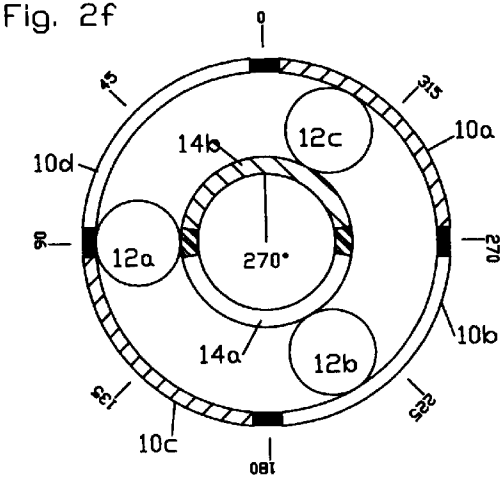

In FIG. 1*b*, the principle of the present invention is illustrated with respect to a preferred embodiment in which two continuously connected channels are provided in the single conducting band layer by segmenting the ring band into four conducting segments 10*a*, 10*b*, 10*c*, 10*d* which are arranged at 90° intervals and are electrically insulated from each other by ring band spacers 11. The sun band is segmented into two conducting segments 14*a*, 14*b* which are arranged at 180° intervals in alignment with the ring band segments and are electrically insulated from each other by sun band spacers 13. Three planetary bands 12*a*, 12*b*, 12*c* are arranged at 120° intervals and are in rolling electrical contact between the ring band segments and the sun band segments. Each two opposed ring band segments 10*a*, 10*c* and 10*b*, 10*d* are paired together and are connected by the rolling planetary bands with one of the sun band segments 14*a* and 14*b*, to form a respective channel (channel 1, channel 2). With these numbers and arrangement, at least one planetary band is in rolling contact between each pair of ring band segments and a corresponding sun band segment at all times. Due to the presence of the insulative spacers, the two channels are electrically insulated from each other at all times. Thus, two separate, continuously connected channels are provided in the single-layer band-gear system.

In FIGS. 2*a*–2*f*, the positions of the four ring band segments, three planetary bands, and two sun band segments are shown at different phases of one complete revolution of the ring gear. For rotation of the ring gear in the clockwise direction (dashed line in FIG. 2*a*), the relative rotation of the planetary gears 12*a*, 12*b*, 12*c* and the sun gear is counterclockwise. By selecting a simple ratio of the number of inner teeth (radius) of the ring gear to be 2:1 to the number of teeth (radius) of the sun gear, every complete revolution of the sun produces revolution of the planet gears and movement ⅓ the way (120°) around the sun. The planet 12*a* is in contact between the sun segment 14*a* and the ring segment 10*d* in FIG. 12*b*, both planets 12*a* and 12*b* with sun segment 10*d* and 10*b* in FIG. 2*c*, then planet 12*c* with sun segment 14*a* in FIG. 12*d*, to maintain the continuous contact for channel 1. The pattern is repeated with planets 12*c* and 12*a* for the next ⅓ movement around the sun between FIGS. 2*d* and 2*e*, and with planets 12*b* and 12*c* for the final ⅓ movement around the sun between FIGS. 2*e* and 2*f*.

In the band-gear system, no timing or switching devices are used. The kinematics of the planetary gears and the 2:1 gear ratio between the sun and ring gears force the planets to repeat their pattern every ⅓ revolution of the sun. By using three planets 120° apart, at least one but no more than two planets land between the sun and ring segments dedicated to one of the two channels at all times. The two channels will not short circuit because of the kinematics of the system and the separation by the spacers. Two opposing ring segments are interconnected with one of the sun segments for each of the channels.

The geared aspect of the band-gear system simplifies axial alignment and maintains mechanical stability in the relative positions (within the annulus) of the conducting planet gears. Two continuous channels are provided in a single axial layer without having to increase the axial length of the system. The current carrying capacity of each channel is dependent upon the number of planet gear assemblies in contact with each conducting band section of the ring gear assembly.

Figure 3:
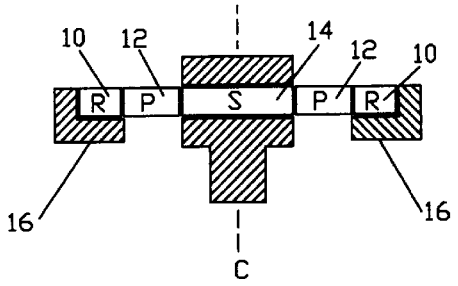
FIG. 3 shows a plan view of the arrangement of ring gear, planetary gear, and sun gear assemblies in a typical band-gear system.
Figure 4:
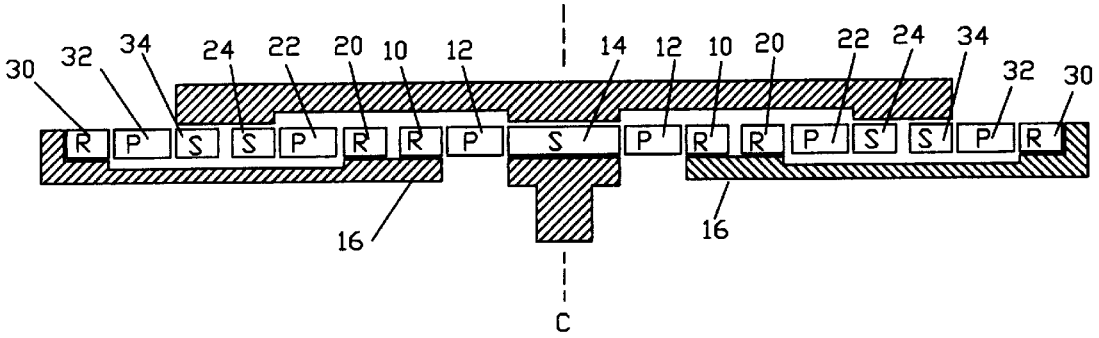
FIG. 4 shows a plan view of the arrangement of multiple stacked sets of ring gear, planetary gear, and sun gear assemblies in a band-gear system.

As a variation, the number of channels can be multiplied using multiple stacked sets of ring gear, planetary gear, and sun gear assemblies. As compared to the single set of ring gear 10, planet gear 12, and sun gear 14 assemblies retained in the housing 16 around the center axis C (and rotary shaft) in FIG. 3, the multi-stacked band-gear system in FIG. 4 has an inner first set of sun gear 14, planet gear 12, and ring gear 10 assemblies, an intermediate second set of ring gear 20, planet gear 22, and sun gear 24 assemblies, and an outer third set of ring gear 30, planet gear 32, and sun gear 34 assemblies which double the number of separate continuous channels to four without increasing the axial length of the system. The sun gear of the second set is an internal rather an external gear and the ring gear is external. As shown in FIG. 4, the third set with an external sun gear and an internal ring gear is added to the outside of the second set.

The number of sets that can be stacked is limited by the overall outside diameter of the system. The suns (rotating parts of the system) are mechanically connected together by an output shaft but insulated electrically. The electrically insulated rings (the stationary part) are mounted to the housing of the system. The planets of each set revolve about their own sun and ring.

The present invention can thus increase the number of channels of a band-gear system without increasing the axial length of the system or sacrificing system performance. With two or four channels per layer, the addition of one or more axial layers of band contacts can increase the number of channels by multiples of two or four for each increment of axial length.

In some applications where continuous power or signal transmission is not necessary, the channels may be used only during time-multiplexed or phase divided intervals. In that case, the number of channels may be increased by increasing the numbers of ring and sun band segments, or the number of ring and sun band segments may be varied in accordance with the given time-multiplexing or phase division scheme. For example, a non-segmented sun band may be used with a two-segment ring band to provide two channels multiplexed at 180° intervals, or with a four-segment ring band to provide two channels multiplexed at two 90° intervals.

The multi-channel band-gear system of the invention may be used in a wide range of applications providing improvements over current technology by allowing multiple separate channel controls without increasing the size of the system. For example, in robotics the multi-channel band-gear system may be used to mechanically power a robot wrist joint while maintaining separate data signal channels across the joint to separately control the fingers of or tools held in the robot hand. Multiple sensor systems may be maintained across a rotating joint without the use of slip rings or separate data transmission systems.

Although the invention has been described with reference to certain preferred embodiments, it will be appreciated that many variations and modifications may be made consistent with the principles of the invention disclosed herein. It is intended that the preferred embodiments and all such variations and modifications be included within the scope and spirit of the invention, as defined in the following claims.

I claims:

1. A multi-channel band-gear system comprising:

a ring gear assembly having a conducting ring band mounted concentrically therewith;

a set of intermediary planet gear assemblies each having a conducting planetary band mounted concentrically therewith; and a sun gear assembly having a conducting sun band mounted concentrically therewith, wherein the planetary bands of the planetary gear assemblies are in rolling electrical contact between the ring band of the ring gear assembly and the sun band of the sun gear assembly, and wherein the ring band is formed with a first plurality of conducting segments which are electrically insulated from each other and positioned angularly in a circumferential direction of the ring band so as to form a multiplicity of electrically connected channels through the ring, planetary, and sun bands of the band-gear system, wherein said ring band has four conducting segments arranged at 90° intervals and electrically insulated from each other, said sun band has two conducting segments arranged at 180° intervals in alignment with the ring band segments and electrically insulated from each other, and three planetary bands are provided in rolling electrical contact at 120° intervals between the ring band segments and the sun band segments, and wherein each two opposed ring band segments are paired together and at least one planetary band is in rolling electrical contact between each pair of ring band segments and a corresponding one of the sun band segments at all times, so that two continuously connected channels are provided in a single layer of the band-gear system.

2. A multi-channel band-gear system according to claim 1, wherein said sun gear assembly is mounted to a rotary shaft on a center axis of the band-gear system.

3. A multi-channel band-gear system according to claim 1, further comprising additional stacked sets of ring gear, planetary gear, and sun gear assemblies for increasing the number of channels provided in the band-gear system.

4. A multi-channel band-gear system according to claim 3, wherein the first-mentioned ring gear, planetary gear, and sun gear assemblies constitute an inner first set of assemblies, further comprising an intermediate second set of ring gear, planet gear, and sun gear assemblies in geared engagement with the assemblies of the first set, and a third set of ring gear, planet gear, and sun gear assemblies in geared engagement with the assemblies of the second set.

5. A multi-channel band-gear system according to claim 4, wherein four continuously connected channels are provided through the ring, planetary, and sun bands of the three sets in a single layer of the band-gear system.

* * * * *